US006454662B1

(12) United States Patent
Cheng

(10) Patent No.: US 6,454,662 B1
(45) **Date of Patent: *Sep. 24, 2002**

(54) GOLF CLUB SHAFT HAVING MULTIPLE CONICAL SECTIONS

(75) Inventor: Michael H. L. Cheng, Simi Valley, CA (US)

(73) Assignee: Harrison Sports, Inc., Pacoima, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/386,767

(22) Filed: Aug. 31, 1999

Related U.S. Application Data

(63) Continuation of application No. 08/968,748, filed on Jul. 22, 1997, now Pat. No. 5,944,618.

(51) Int. Cl.[7] ..... A63B 53/10
(52) U.S. Cl. ..... 473/319
(58) Field of Search ..... 473/316–323

(56) References Cited

U.S. PATENT DOCUMENTS

| | | | | |
|---|---|---|---|---|
| 2,050,554 A | * | 8/1936 | Barnhart | |
| 2,086,275 A | | 7/1937 | Lemmon | |
| 2,117,129 A | | 5/1938 | Young | |
| 2,250,441 A | | 7/1941 | Vickery | |
| 3,809,403 A | | 5/1974 | Hunter | |
| 4,205,845 A | | 6/1980 | Kanne | |
| 4,431,187 A | | 2/1984 | Rumble | |
| RE33,735 E | | 11/1991 | Rumble | |
| 5,251,896 A | | 10/1993 | Gerlach | |
| 5,316,299 A | | 5/1994 | Feche | |
| 5,496,028 A | | 3/1996 | Chien | |
| 5,599,242 A | * | 2/1997 | Solviche | |
| 5,620,380 A | * | 4/1997 | Tennent | |
| 5,665,010 A | | 9/1997 | Mori | |
| 5,685,781 A | * | 11/1997 | Pedersen | |
| 5,685,783 A | * | 11/1997 | Akatsuka | 473/319 |
| 5,695,408 A | | 12/1997 | DeLaCruz | |
| 5,716,291 A | * | 2/1998 | Morell | 473/319 |
| 5,735,753 A | | 4/1998 | Hoffmeyer | |
| 5,755,826 A | | 5/1998 | Beach | |
| 5,813,922 A | * | 9/1998 | Beach | 473/319 |
| 5,944,618 A | | 8/1999 | Cheng | |
| 5,957,783 A | | 9/1999 | Cheng | |
| 5,993,328 A | * | 11/1999 | Pedersen | 473/318 |

FOREIGN PATENT DOCUMENTS

| | | |
|---|---|---|
| GB | 389535 | 3/1933 |

* cited by examiner

*Primary Examiner*—Stephen Blau
(74) *Attorney, Agent, or Firm*—Henricks, Slavin & Holmes LLP

(57) ABSTRACT

A golf club shaft having a stiffness control section between the grip section and the main body section. The stiffness control section includes a first tapered portion and a second tapered portion. The circumference of the first tapered portion increases from the proximal end to the distal end thereof and the circumference of the second tapered portion decreases from the proximal end to the distal end thereof.

37 Claims, 2 Drawing Sheets

GOLF CLUB SHAFT HAVING MULTIPLE CONICAL SECTIONS

CROSS-REFERENCE TO RELATED APPLICATIONS

This application is a continuation of U.S. application Ser. No. 08/968,748, filed Jul. 22, 1997, now U.S. Pat. No. 5,944,618.

BACKGROUND OF THE INVENTION

1. Field of Invention

The present invention relates generally to golf clubs and, more particularly, to golf club shafts.

2. Description of the Related Art

Over the years, many substitutes have been introduced for the hard wood shafts originally used in golf club drivers and irons. Early substitute materials included stainless steel and aluminum. More recently, carbon fiber reinforced resin shafts have become popular. Fiber reinforced resin shafts are typically hollow and consist of a shaft wall formed around a tapered mandrel. The mandrel typically consists of three mandrel sections. The first mandrel section forms the tip section of the shaft, the second mandrel section forms the main body section, and the third mandrel section forms the grip section. As shown in FIG. 1, shafts formed in this manner typically have a constant taper from the tip/main body intersection to the main body/grip intersection. In other words, the taper of the main body section is constant. Additionally, in order to reduce the weight of the shaft, the shaft wall thickness in conventional shafts tends to decrease uniformly (i.e. at a constant rate without abrupt changes), at least from the tip/main body intersection to the main body/grip intersection.

The use of fiber reinforced resin has allowed golf club manufacturers to produce shafts having varying degrees of torsional and longitudinal stiffness to satisfy the needs of a wide variety of golfers. Torsional stiffness relates to a golf club's ability to resist twisting along its length when a golf ball is struck. The inertia of the ball produces a force on the head tending to rotate the head about the axis of the shaft relative to the grip section. Longitudinal stiffness refers to a golf club's ability to resist bending when subjected to a force.

For a given grip outer diameter (OD) and a given tip OD, the conventional method of increasing the torsional and longitudinal stiffness of a fiber reinforced resin shaft is to increase the thickness of the shaft wall. However, because the fiber reinforced resins used to make the shaft are expensive, the use of additional material to increase the shaft wall thickness raises the cost of the shaft to an undesirable level. Additionally, increasing the shaft wall thickness adds weight to the shaft, which is also undesirable. Another method of increasing torsional and longitudinal stiffness is to use materials with a higher modulous of stiffness. Due to the higher cost of these materials, this method is also undesirable.

More recently, so-called "bubble" or "wide body" shafts have been introduced in an attempt to increase shaft stiffness. Here, the OD of selected portions of the main body section is greater than that of a shaft having a constant taper from the tip section to grip section. In some cases, the main body section's proximal portion (the portion of the main body section closest to the golfer) will have a greater OD than the distal end of the grip section (the end of the grip section farthest from the golfer). As such, the main body section of certain "bubble" or "wide body" shafts includes a short connecting portion which rapidly decreases in diameter, thereby connecting the main body section to the grip section. Such a shaft is disclosed in U.S. Pat. No. 5,316,299 to Feche et al. The shaft stiffness is generally greater in "bubble" or "wide body" shafts than in conventional shafts formed with the same materials and having the same wall thickness. Nevertheless, there are limitations with respect to the maximum OD of the main body section. Accordingly, there is a need for additional methods of increasing shaft stiffness that do not substantially increase the weight or cost of the shaft.

SUMMARY OF THE INVENTION

Accordingly, the general object of the present invention is to provide a golf club shaft which avoids, for practical purposes, the aforementioned problems. In particular, one object of the present invention is to provide a golf club shaft which has greater longitudinal and torsional stiffness than conventional shafts with the same tip OD and grip OD. Another object of the present invention is to provide a golf club shaft which has greater longitudinal and torsional stiffness than conventional shafts with the same tip OD and grip OD without substantially increasing the cost of the shaft. Still another object of the present invention is to provide a method of manufacturing golf club shafts which allows the longitudinal and torsional stiffness to be easily varied for a given tip OD and grip OD without substantially varying the weight of the shaft.

In order to accomplish these and other objectives, a golf club shaft in accordance with one embodiment of the present invention has a stiffness control section between the grip section and the main body section. The stiffness control section includes a first tapered portion and a second tapered portion. The circumference of the first tapered portion increases from the proximal end to the distal end thereof and the circumference of the second tapered portion decreases from the proximal end to the distal end thereof.

The present invention provides a number of advantages over the prior art. For example, a shaft with the present stiffness control section has greater longitudinal and torsional stiffness than a shaft with a continuous taper or conventional shafts with the same tip OD and grip OD. Moreover, the present invention does so without increasing the cost or weight of the shaft. Alternatively, the present invention may be used to provide a shaft that, although lighter in weight, has the same stiffness, tip OD and grip OD as a conventional shaft. The present invention also provides a number of advantages over "bubble" shafts. In order to increase the stiffness of a "bubble" shaft, the size of the bubble portion is increased, which can adversely effect the appearance of the shaft. On the other hand, increasing stiffness through the use of conical sections, as in the present invention, provides more gradual diametric changes and a less abrupt appearance. Additionally, adjusting the length of the present stiffness control section allows the shaft's point of maximum OD to be moved towards the tip of the shaft, thereby increasing the stiffness of the shaft and lowering torque. Such adjustments are not possible with "bubble" shafts.

The above described and many other features and attendant advantages of the present invention will become apparent as the invention becomes better understood by reference to the following detailed description when considered in conjunction with the accompanying drawings.

BRIEF DESCRIPTION OF THE DRAWINGS

Detailed description of preferred embodiments of the invention will be made with reference to the accompanying drawings.

DETAILED DESCRIPTION OF THE PREFERRED EMBODIMENTS

The following is a detailed description of the best presently known mode of carrying out the invention. This description is not to be taken in a limiting sense, but is made merely for the purpose of illustrating the general principles of the invention. The scope of the invention is defined by the appended claims.

Figure 1:
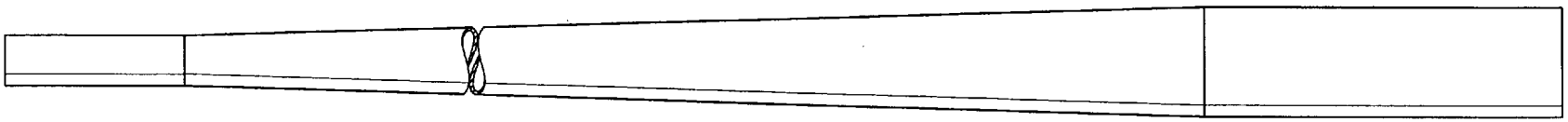
FIG. 1 PRIOR ART
FIG. 1 is a side view of a conventional shaft.
Figure 2:
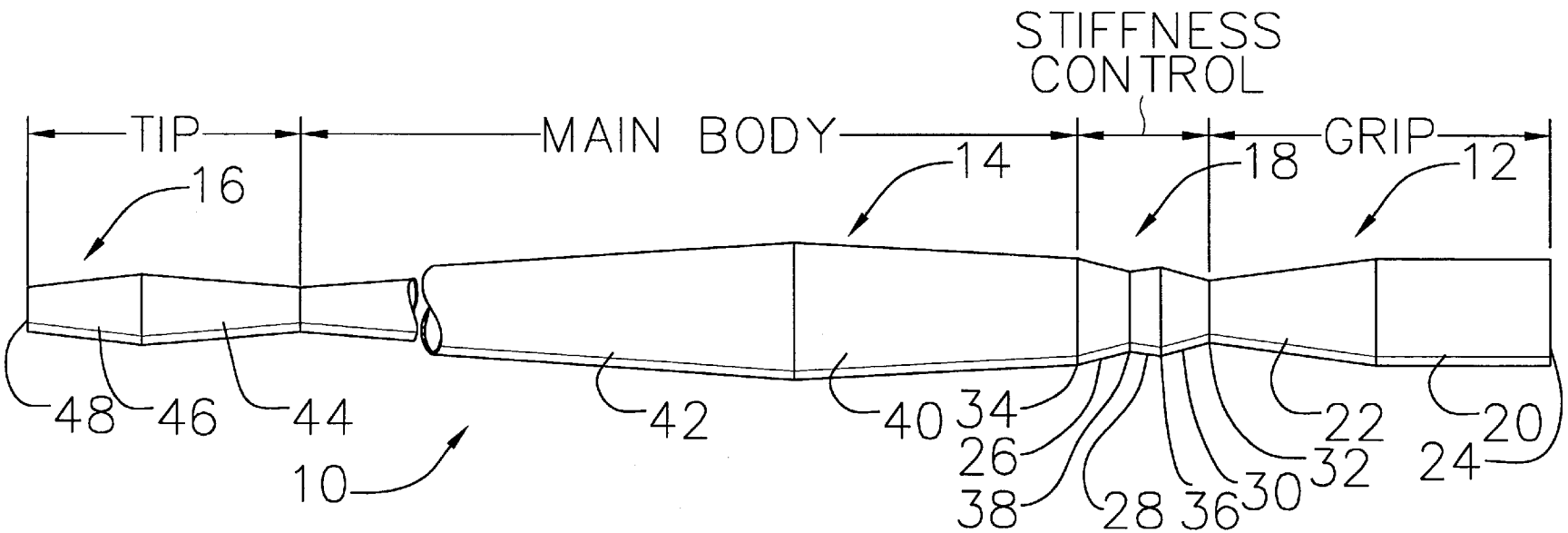
FIG. 2 is a side view of a golf club shaft in accordance with a preferred embodiment of the present invention.

As illustrated for example in FIG. 2, a golf club shaft 10 in accordance with a preferred embodiment of the present invention includes a grip section 12, a main body section 14, a tip section 16 and a stiffness control section 18 between the main body section and the grip section. The grip section 12 will typically support a grip that allows the golfer to firmly grasp the shaft. However, the grip need not extend over the full length of the grip section. The tip section 16 is inserted into the hosel of a club head. The exemplary grip section 12, which includes a cylindrical portion 20 and a frusto-conically shaped tapered portion 22, defines the butt end 24 of the shaft. This configuration provides a more anatomically correct and ergonomic grip section than cylindrical grip sections and grip sections with constant tapers. The OD (and circumference) of the tapered portion 22 decreases from the proximal end to the distal end. Portion 20 may, alternatively, have a relatively slight taper (i.e. less than that of portion 22).

The exemplary stiffness control section 18 includes frusto-conically shaped tapered portions 26, 28 and 30. The OD (and circumference) of the tapered portions 26 and 30 increase from their respective proximal ends to their respective distal ends, while the OD (and circumference) of the tapered portion 28 decreases from its proximal end to its distal end. Additionally, the respective junctions between the grip section, tapered portions 26, 28 and 30, and main body section may be relatively abrupt (i.e. defining a sharp corner) as shown, or rounded.

In the exemplary embodiment shown in FIG. 2, the OD (and circumference) at the grip section/stiffness control section junction 32 is less than that of stiffness control section/main body section junction 34. Additionally, the OD (and circumference) of the distal end 36 of the tapered portion 30 is greater than that of the distal end 38 of the tapered portion 28, but less than that of the stiffness control section/main body section junction 34.

Figure 5:
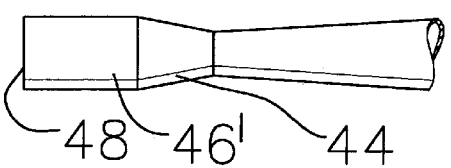
FIG. 5 is a partial side view of a golf club shaft in accordance with another preferred embodiment of the present invention.

With respect to the main body section 14 and tip section 16 of the exemplary shaft shown in FIG. 2, the main body section includes frusto-conically shaped tapered portions 40 and 42. The OD (and circumference) of tapered portion 40 increases from its proximal end to its distal end, while that of the tapered portion 42 decreases from its proximal end to its distal end. The tip section 16 includes frusto-conically shaped tapered portions 44 and 46. Tapered portion 44 is relatively short, while tapered portion 46 is longer and defines the shaft tip end 48. Alternatively, as shown in FIG. 5, portion 46' may be substantially cylindrical (or tubular).

Figure 3:
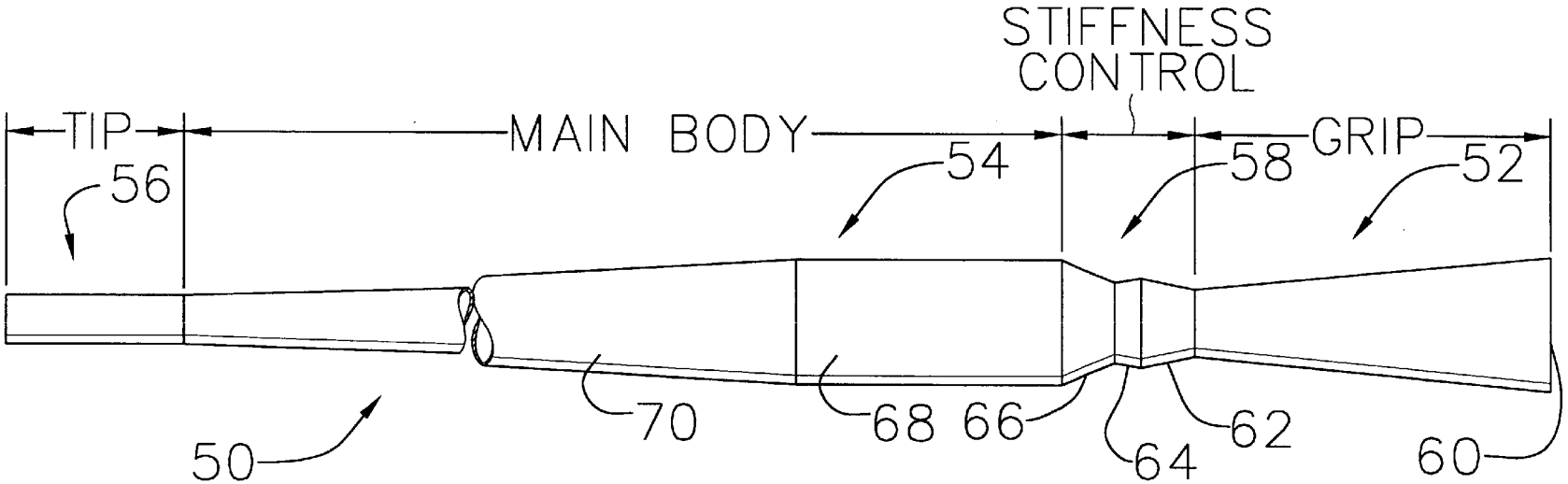
FIG. 3 is a side view of a golf club shaft in accordance with another preferred embodiment of the present invention.

Turning to FIG. 3, an exemplary shaft 50 in accordance with another embodiment of the present invention includes a grip section 52, a main body section 54, a tip section 56 and a stiffness control section 58 between the main body section and the grip section. The grip section 52 in this embodiment is frusto-conically shaped and defines the butt end 60. The exemplary stiffness control section 58, which is substantially similar to the stiffness control section 18 discussed above with respect to FIG. 2, includes frusto-conically shaped tapered portions 62, 64 and 66. Main body section 54 includes a substantially cylindrical (or tubular) portion 68 and a frusto-conically shaped tapered portion 70. Alternatively, portion 68 may be a frusto-conically shaped tapered portion. The exemplary tip section 56 is substantially cylindrical (or tubular). The tip section 56 may, alternatively, be frusto-conically shaped.

Figure 4:
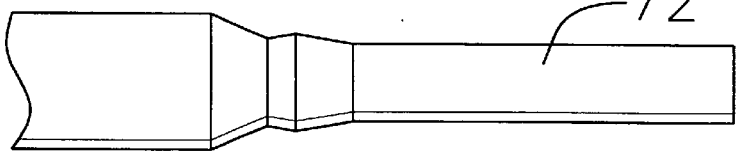
FIG. 4 is a partial side view of a golf club shaft in accordance with another preferred embodiment of the present invention.

As shown by way of example in FIG. 4, the grip sections shown in FIGS. 2 and 3 may be replaced with a substantially cylindrical (or tubular) grip section 72.

Commercial embodiments of shafts in accordance with the present invention may be configured as follows. The overall length of the shaft may range from about 33 inches to about 46 inches. With respect to the tip section, the overall length may range from about 4 inches to about 6 inches. In the embodiment shown in FIG. 2, the length of portion 44 may range from about 1 inch to about 2 inches and the length of portion 46 may range from about 3 inches to about 4 inches. Additionally, the OD of tapered portion 44 tapers from an OD of between about 0.335 inch and about 0.465 inch to an OD of between about 0.370 inch and about 0.500 inch for woods, and from between about 0.370 inch and about 0.500 inch to between about 0.400 inch and about 0.530 inch for irons. The OD of tapered portion 46 tapers from an OD of between about 0.335 inch and about 0.465 inch to an OD of between about 0.370 inch and about 0.500 inch for woods, and from between about 0.370 inch and about 0.500 inch to between about 0.400 inch to about 0.530 inch for irons. In the embodiment shown in FIG. 3, the tip section OD may range from about 0.37 inch to about 0.50 inch for irons and from about 0.335 to about 0.50 inch for woods.

The length of the grip sections shown in FIGS. 2–4 may range from about 8 inches to about 10 inches. The OD of cylindrical portion 20 of the exemplary grip section 12 shown in FIG. 2 is between about 0.8 inch and about 1.0 inch, while the tapered portion 22 tapers from an OD of between about 0.55 inch and about 0.70 inch to between about 0.81 inch and about 1.0 inch. The exemplary grip section shown in FIG. 3 tapers from an OD of between about 0.81 and about 1.00 inch at the butt end to between about 0.55 inch and about 0.70 inch at the grip/main body intersection. With respect to the grip section 72 shown in FIG. 4, the OD is between about 0.58 inch and about 0.62 inch.

With respect to the exemplary main body section 14 shown in FIG. 2, the OD of tapered portion 40 tapers from an OD of between about 0.75 inch and about 0.95 inch at the main body section/grip section junction to an OD of between about 0.8 inch and about 1.0 The OD of tapered portion 42 tapers from an OD of between about 0.8 inch and about 1.0 inch to between about 0.335 inch and about 0.530 inch at the main body section/tip section junction. The tapered portion 40 may range in length from about 3 inches to about 8 inches, while the length of tapered portion 42 may range from about 17 inches to about 26 inches for woods and from about 13 inches to about 20 inches for irons.

In the exemplary main body section 54 shown in FIG. 3, the OD of tapered portion 68 is between about 0.75 inch and about 1.0 inch. The OD of tapered portion 70 tapers from an OD of between about 0.75 inch and about 1.0 inch to between about 0.335 inch and about 0.530 inch at the main body section/tip section junction. The tapered portion 68 may range in length from about 3 inches to about 10 inches, while the length of tapered portion 70 may range from about 15 inches to about 26 inches for woods and from about 11 inches to about 20 inches for irons. In commercial versions of either of the illustrated embodiments, the main body section will be between about 30% and about 62% of the overall length.

Stiffness control sections 18 and 58, which are illustrated for example in FIGS. 2 and 3, have the same dimensions. Referring to FIG. 2, the length of the tapered portion 26 is between about 0.5 inch and about 2.5 inch, while the OD tapers from between about 0.70 inch and about 0.95 inch to between about 0.60 which and about 0.80 inch. The length of the tapered portion 28 is between about 0.25 inch and about 0.75 inch, while the OD tapers from between about 0.65 inch and about 0.85 inch to between about 0.60 inch and about 0.80 inch. The length of the tapered portion 30 is between also about 0.5 inch and about 2.5 inch, while the OD tapers from between about 0.55 inch and about 0.70 inch to between about 0.65 inch and about 0.85 inch. In the illustrated embodiments, the stiffness control section is between about 2% and about 12% of the overall length of the shaft.

Turning to the wall thickness of the commercial embodiments, the wall thickness of the tip section is preferably between about 0.061 inch to about 0.089 inch. The thickness of the main body section preferably decreases at a constant rate from the tip section to a thickness of between about 0.028 inch and about 0.037 inch at the intersection with the stiffness control section. The thickness varies from between about 0.028 inch and about 0.037 inch at the distal end of the stiffness control section to between about 0.030 inch and about 0.041 inch at the proximal end of the stiffness control section. The thickness of the grip section is between about 0.030 inch and about 0.041 at the distal end and is between about 0.033 inch and 0.044 inch at the proximal (or butt) end of the shaft. However, the wall thickness is preferably uniform about the circumference of the shaft at any given location along the longitudinal axis of the shaft.

The present invention may be practiced with any of the materials typically used to produce composite resin/fiber golf club shafts. Suitable resins include, for example, thermosetting resins or polymers such as polyesters, epoxies, phenolics, melamines, silicones, polyimides, polyurethanes, or other thermoplastics. Suitable fibers include, for example, carbon-based fibers such as graphite, glass fibers, aramid fibers, and extended chain polyethylene fibers. The preferred method of manufacturing is a bladder mold process. After successive layers (preferably 10–20) of fiber reinforced resin are wrapped around a bladder, a mold is placed over the wrapped bladder. The bladder is then expanded to force the material against the mold. The shaft is then cured in an oven. Curing times and temperatures depend on the polymer used in the composite and are well known to those of skill in the art. Alternatively, the present shaft may be manufactured by wrapping successive layers of fiber reinforced resin around a suitably shaped mandrel and then curing the shaft in an oven.

With respect to the layer wrapping employed in either process, the fibers of each successive layer are preferably oriented at different angles with respect to the longitudinal axis of the shaft. The fibers of some layers may be parallel to the longitudinal axis, while the fibers of other layers are angled from 30–90 degrees with respect to the longitudinal axis. It should be noted, however, that the fibers of successive layers, such as the outer layers, may be parallel to one another. Other layer combinations are also possible. For example, the first 5 to 10 layers may be alternating angled layers, and the next 5 to 10 layers may be parallel to the longitudinal axis.

Other manufacturing methods that may be used in conjunction with the present invention include filament winding and resin transfer molding.

Although the present invention has been described in terms of the preferred embodiment above, numerous modifications and/or additions to the above-described preferred embodiments would be readily apparent to one skilled in the art. It is intended that the scope of the present invention extends to all such modifications and/or additions and that the scope of the present invention is limited solely by the claims set forth below.

I claim:

1. A golf club shaft, comprising:

a tip section defining a length, a distal end, a proximal end and a longitudinal axis;

a grip section defining a length, a distal end, a proximal end, a longitudinal axis, a distal portion outer surface slope and a distal end circumference;

a main body section extending from the proximal end of the tip section and defining a length, a longitudinal axis, a proximal end, a proximal portion outer surface slope and a proximal end circumference that is greater than the distal end circumference of the grip section; and a stiffness control section, between the proximal end of the main body section and the distal end of the grip section, defining a length, a longitudinal axis and at least one of a substantially constant and a slightly tapered wall thickness, the stiffness control section including at least a first tapered portion defining a distal end, a proximal end, a circumference and an outer surface slope different than the distal portion outer surface slope of the grip section, and a second tapered portion defining a distal end, a proximal end, a circumference, and an outer surface slope different than the outer surface slope of the first tapered portion and the outer surface slope of the main body section proximal portion, the second tapered portion abutting the first tapered portion to define an intersection and the second tapered portion being located between the main body section and the first tapered portion, the circumference of the intersection of the first and second tapered portions being greater than the circumference of the distal end of the grip section;

wherein the sum of the tip section length, grip section length, main body section length and stiffness control section length defines a shaft length, and the stiffness control section length is between about 2% and about 12% of the shaft length.

2. A golf club shaft as claimed in claim 1, wherein the first and second tapered portions are substantially frustoconically shaped.

3. A golf club shaft as claimed in claim 1, wherein the main body section includes a first tapered portion defining a distal end, a proximal end and a circumference and a second tapered portion defining a distal end, a proximal end and a circumference, the circumference of the first tapered portion increasing from the proximal end to the distal end thereof and the circumference of the second tapered portion decreasing from the proximal end to the distal end thereof.

4. A golf club shaft as claimed in claim 1, wherein the grip section defines a circumference, the circumference of the grip section decreasing from the proximal end to the distal end thereof.

5. A golf club shaft as claimed in claim 1, wherein the grip section defines a circumference, the circumference of the grip section being substantially constant from the proximal end to the distal end thereof.

6. A golf club shaft as claimed in claim 1, wherein grip section includes a first portion defining a distal end, a proximal end and a circumference and a second portion defining a distal end, a proximal end and a circumference, the circumference of the first portion being substantially constant from the proximal end to the distal end thereof and the circumference of the second portion decreasing from the proximal end to the distal end thereof.

7. A golf club shaft as claimed in claim 1, wherein the tip section includes a first tapered portion defining a distal end, a proximal end and a circumference and a second tapered portion defining a distal end, a proximal end and a circumference, the circumference of the first tapered portion increasing from the proximal end to the distal end thereof and the circumference of the second tapered portion decreasing from the proximal end to the distal end thereof.

8. A golf club shaft as claimed in claim 1, wherein the tip section includes a substantially cylindrical portion defining a distal end and a proximal end, and a tapered portion defining a distal end, a proximal end and a circumference, the circumference of the tapered portion decreasing from the distal end to the proximal end thereof.

9. A golf club shaft as claimed in claim 1, wherein the tip section defines a circumference, the circumference of the tip section decreasing from the proximal end to the distal end thereof.

10. A golf club shaft as claimed in claim 1, wherein the tip section defines a circumference, the circumference of the tip section being substantially constant from the proximal end to the distal end thereof.

11. A golf club shaft as claimed in claim 1, wherein the main body section length is between about 30% and about 60% of the shaft length.

12. A golf club shaft, comprising:

a tip section defining a distal end, a proximal end and a longitudinal axis;

a grip section defining a distal end, a proximal end, a longitudinal axis, a distal portion outer surface slope and a distal end circumference;

a main body section extending from the proximal end of the tip section and defining a longitudinal axis, a proximal end, a proximal portion outer surface slope and a proximal end circumference that is greater than the distal end circumference of the grip section; and a stiffness control section, between the proximal end of the main body section and the distal end of the grip section, defining a longitudinal axis and at least one of a substantially constant and a slightly tapered wall thickness, the stiffness control section including at least a first tapered portion defining a distal end, a proximal end, a circumference that increases from the proximal end to the distal end thereof and an outer surface slope different than the distal portion outer surface slope of the grip section, and a second tapered portion defining a distal end, a proximal end, a circumference that decreases from the proximal end to the distal end thereof, and an outer surface slope different than the outer surface slope of the first tapered portion and the outer surface slope of the main body section proximal portion, the second tapered portion abutting the first tapered portion to define an intersection and the second tapered portion being located between the main body section and the first tapered portion, the circumference of the intersection of the first and second tapered portions being greater than the circumference of the distal end of the grip section.

13. A golf club shaft, comprising:

a tip section defining a distal end, a proximal end and a longitudinal axis;

a grip section defining a distal end, a proximal end, a longitudinal axis, a distal portion outer surface slope and a distal end circumference;

a main body section extending from the proximal end of the tip section and defining a longitudinal axis, a proximal end, a proximal portion outer surface slope and a proximal end circumference that is greater than the distal end circumference of the grip section; and a stiffness control section, between the proximal end of the main body section and the distal end of the grip section, defining a longitudinal axis and at least one of a substantially constant and a slightly tapered wall thickness, the stiffness control section including at least a first tapered portion defining a distal end, a proximal end, a circumference and an outer surface slope different than the distal portion outer surface slope of the grip section, and a second tapered portion defining a distal end, a proximal end, a circumference, and an outer surface slope different than the outer surface slope of the first tapered portion and the outer surface slope of the main body section proximal portion, the second tapered portion abutting the first tapered portion to define an intersection and the second tapered portion being located between the main body section and the first tapered portion, the circumference of the intersection of the first and second tapered portions being greater than the circumference of the distal end of the grip section and the circumference of the distal end of the first tapered portion being greater than the circumference of the distal end of the second tapered portion.

14. A golf club shaft, comprising:

a tip section defining a distal end, a proximal end and a longitudinal axis;

a grip section defining a distal end, a proximal end, a longitudinal axis and a distal portion outer surface slope;

a main body section extending from the proximal end of the tip section and defining a longitudinal axis and a proximal portion outer surface slope; and a stiffness control section, between the proximal end of the main body section and the distal end of the grip section, defining a longitudinal axis and at least one of a substantially constant and a slightly tapered wall thickness, the stiffness control section including at least a first tapered portion defining a distal end, a proximal end, a circumference and an outer surface slope different than the distal portion outer surface slope of the grip section, a second tapered portion defining a distal end, a proximal end, a circumference, and an outer surface slope different than the outer surface slope of the first tapered portion, the second tapered portion abutting the first tapered portion to define an intersection, and a third tapered portion defining a distal end, a proximal end and a circumference, the second tapered portion being between the first and third tapered portions, the circumference of the intersection of the first and second tapered portions being greater than the circumference of the distal end of the grip section, the circumference of the first tapered portion increasing from the proximal end to the distal end thereof, the circumference of the second tapered portion decreasing from the proximal end to the distal end thereof, and the circumference of the third tapered portion increasing from the proximal end to the distal end thereof.

15. A golf club shaft as claimed in claim 14, wherein the distal ends of the first, second and third tapered portions define respective circumferences, the circumference of the distal end of the first tapered portion being greater than the circumference of the distal end of the second tapered portion, and the circumference of the distal end of the third tapered portion being greater than the circumference of the distal end of the first tapered portion.

16. A golf club shaft as claimed in claim 14, wherein the first and second tapered portions are substantially frustoconically shaped.

17. A golf club shaft as claimed in claim 14, wherein the main body section includes a first tapered portion defining a distal end, a proximal end and a circumference and a second tapered portion defining a distal end, a proximal end and a circumference, the circumference of the first tapered portion increasing from the proximal end to the distal end thereof and the circumference of the second tapered portion decreasing from the proximal end to the distal end thereof.

18. A golf club shaft as claimed in claim 14, wherein the grip section defines a circumference, the circumference of the grip section decreasing from the proximal end to the distal end thereof.

19. A golf club shaft as claimed in claim 14, wherein the grip section defines a circumference, the circumference of the grip section being substantially constant from the proximal end to the distal end thereof.

20. A golf club shaft as claimed in claim 14, wherein grip section includes a first portion defining a distal end, a proximal end and a circumference and a second portion defining a distal end, a proximal end and a circumference, the circumference of the first portion being substantially constant from the proximal end to the distal end thereof and the circumference of the second portion decreasing from the proximal end to the distal end thereof.

21. A golf club shaft as claimed in claim 14, wherein the tip section includes a first tapered portion defining a distal end, a proximal end and a circumference and a second tapered portion defining a distal end, a proximal end and a circumference, the circumference of the first tapered portion increasing from the proximal end to the distal end thereof and the circumference of the second tapered portion decreasing from the proximal end to the distal end thereof.

22. A golf club shaft as claimed in claim 14, wherein the tip section includes a substantially cylindrical portion defining a distal end and a proximal end, and a tapered portion defining a distal end, a proximal end and a circumference, the circumference of the tapered portion decreasing from the distal end to the proximal end thereof.

23. A golf club shaft as claimed in claim 14, wherein the tip section defines a circumference, the circumference of the tip section decreasing from the proximal end to the distal end thereof.

24. A golf club shaft as claimed in claim 14, wherein the tip section defines a circumference, the circumference of the tip section being substantially constant from the proximal end to the distal end thereof.

25. A golf club shaft as claimed in claim 14, wherein the tip section, grip section, main body section and stiffness control section define respective lengths, the sum of the tip section length, grip section length, main body section length and stiffness control section length defines a shaft length, and the stiffness control section length is between about 2% and about 12% of the shaft length.

26. A golf club shaft as claimed in claim 25, wherein the main body section length is between about 30% and about 60% of the shaft length.

27. A golf club shaft, comprising:

a tip section defining a distal end, a proximal end and a longitudinal axis;

a grip section defining a distal end, a proximal end, a longitudinal axis and a distal portion outer surface slope;

a main body section extending from the proximal end of the tip section and defining a longitudinal axis and a proximal portion outer surface slope, the main body section including a first portion defining a distal end, a proximal end and a circumference and a second portion defining a distal end, a proximal end and a circumference, the circumference of the first portion being substantially constant from the proximal end to the distal end thereof and the circumference of the second portion decreasing from the proximal end to the distal end thereof; and a stiffness control section, between the proximal end of the main body section and the distal end of the grip section, defining a longitudinal axis and at least one of a substantially constant and a slightly tapered wall thickness, the stiffness control section including at least a first tapered portion defining a distal end, a proximal end, a circumference and an outer surface slope different than the distal portion outer surface slope of the grip section, and a second tapered portion defining a distal end, a proximal end, a circumference, and an outer surface slope different than the outer surface slope of the first tapered portion, the second tapered portion abutting the first tapered portion to define an intersection, the circumference of the intersection of the first and second tapered portions being greater than the circumference of the distal end of the grip section.

28. A golf club shaft as claimed in claim 27, wherein the first and second tapered portions are substantially frustoconically shaped.

29. A golf club shaft as claimed in claim 27, wherein the grip section defines a circumference, the circumference of the grip section decreasing from the proximal end to the distal end thereof.

30. A golf club shaft as claimed in claim 27, wherein the grip section defines a circumference, the circumference of the grip section being substantially constant from the proximal end to the distal end thereof.

31. A golf club shaft as claimed in claim 27, wherein grip section includes a first portion defining a distal end, a proximal end and a circumference and a second portion defining a distal end, a proximal end and a circumference, the circumference of the first portion being substantially constant from the proximal end to the distal end thereof and the circumference of the second portion decreasing from the proximal end to the distal end thereof.

32. A golf club shaft as claimed in claim 27, wherein the tip section includes a first tapered portion defining a distal end, a proximal end and a circumference and a second tapered portion defining a distal end, a proximal end and a circumference, the circumference of the first tapered portion increasing from the proximal end to the distal end thereof and the circumference of the second tapered portion decreasing from the proximal end to the distal end thereof.

33. A golf club shaft as claimed in claim 27, wherein the tip section includes a substantially cylindrical portion defining a distal end and a proximal end, and a tapered portion defining a distal end, a proximal end and a circumference, the circumference of the tapered portion decreasing from the distal end to the proximal end thereof.

34. A golf shaft as claimed in claim 27, wherein the tip section defines a circumference, the circumference section decreasing from the proximal end to the distal end thereof.

35. A golf club shaft as claimed in claim 27, wherein the tip section defines a circumference, the circumference of the tip section being substantially constant from the proximal end to the distal end thereof.

36. A golf club shaft as claimed in claim 26, wherein the tip section, grip section, main body section and stiffness control section define respective lengths, the sum of the tip section length, grip section length, main body section length and stiffness control section length defines a shaft length, and the stiffness control section length is between about 2% and about 12% of the shaft length.

37. A golf club shaft as claimed in claim 36, wherein the main body section length is between about 30% and about 60% of the shaft length.

* * * * *